US008721389B2

(12) United States Patent
Jung et al.

(10) Patent No.: US 8,721,389 B2
(45) Date of Patent: May 13, 2014

(54) GRINDER, GRINDING METHOD USING THE GRINDER, MANUFACTURING METHOD OF DISPLAY DEVICE USING THE GRINDING METHOD, AND DISPLAY DEVICE MANUFACTURED BY THE MANUFACTURING METHOD

(75) Inventors: Jong-Sub Jung, Yongin (KR); Weon-Woo Choi, Yongin (KR); Dong-Wok Seo, Yongin (KR); Kwan-Su Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 572 days.

(21) Appl. No.: 13/013,756

(22) Filed: Jan. 25, 2011

(65) Prior Publication Data

US 2011/0223839 A1 Sep. 15, 2011

(30) Foreign Application Priority Data

Mar. 11, 2010 (KR) ..... 10-2010-0022003

(51) Int. Cl.
*B24B 1/00* (2006.01)

(52) U.S. Cl.
USPC ..... 451/41; 451/44; 451/54; 451/57; 451/70; 349/187; 349/189

(58) Field of Classification Search
USPC ..... 451/41, 44, 54, 57, 58, 67, 69, 70; 349/187, 189, 190
See application file for complete search history.

(56) References Cited

U.S. PATENT DOCUMENTS

| | | | | |
|---|---|---|---|---|
| 4,958,463 | A | 9/1990 | Hess et al. | |
| 6,580,489 | B2 * | 6/2003 | Choo et al. | 349/187 |
| 6,822,725 | B2 * | 11/2004 | Choo et al. | 349/187 |
| 7,163,445 | B2 * | 1/2007 | Uh et al. | 451/41 |
| 7,329,169 | B2 * | 2/2008 | Uh et al. | 451/10 |
| 7,607,971 | B2 * | 10/2009 | Choo et al. | 451/44 |
| 7,988,532 | B2 * | 8/2011 | Choo et al. | 451/10 |
| 2005/0090186 | A1 * | 4/2005 | Uh et al. | 451/5 |
| 2006/0040594 | A1 * | 2/2006 | Uh et al. | 451/41 |
| 2007/0099544 | A1 * | 5/2007 | Uh et al. | 451/5 |
| 2008/0239230 | A1 | 10/2008 | Yamazaki et al. | |
| 2009/0086153 | A1 | 4/2009 | Hayakawa et al. | |
| 2010/0009590 | A1 * | 1/2010 | Choo et al. | 445/66 |
| 2010/0276704 | A1 | 11/2010 | Park et al. | |

FOREIGN PATENT DOCUMENTS

| | | | |
|---|---|---|---|
| CN | 1030739 | A | 2/1989 |
| CN | 1320234 | A | 10/2001 |
| CN | 1490347 | A | 4/2004 |
| CN | 1511076 | A | 7/2004 |

(Continued)

OTHER PUBLICATIONS

English translation of paragraph No. 1, p. 9 of German Publication DE 2009 778, dated Sep. 16, 1971, previously filed in an IDS dated Mar. 26, 2013.

*Primary Examiner* — Eileen P. Morgan
(74) *Attorney, Agent, or Firm* — Christie, Parker & Hale, LLP

(57) ABSTRACT

A grinder including a grinding unit including a grinding surface and a shaft connected to the grinding unit for rotating the grinding unit. The grinding unit includes polyurethane and a mixture of a repairer and an abrasive, and an angle α between a plane perpendicular to a rotational axis of the shaft and the grinding surface satisfies $1° \leq \alpha \leq 7°$.

8 Claims, 14 Drawing Sheets

(56) References Cited

FOREIGN PATENT DOCUMENTS

| | | | |
|---|---|---|---|
| CN | 101369072 | A | 2/2009 |
| CN | 101431093 | A | 5/2009 |
| CN | 101542372 | A | 9/2009 |
| CN | 101630085 | A | 1/2010 |
| DE | 2009 778 | | 9/1971 |
| EP | 0 604 395 | A2 | 6/1994 |
| JP | 06-344266 | | 12/1994 |
| JP | 08-323598 | | 12/1996 |
| JP | 09-076161 | A | 3/1997 |
| JP | 11-033889 | A | 2/1999 |
| JP | 2004-261942 | A | 9/2004 |
| JP | 2006-326787 | A | 12/2006 |
| JP | 2007-001000 | A | 1/2007 |
| JP | 2009-274174 | | 11/2009 |
| KR | 2006-0031827 | A | 4/2006 |
| KR | 10-0591187 | | 6/2006 |
| KR | 10-0895830 | B1 | 4/2009 |
| TW | 200927387 | | 7/2009 |
| WO | WO 2004/050306 | A1 | 6/2004 |
| WO | WO 2005/123332 | A3 | 12/2005 |
| WO | WO 2006/066976 | A1 | 6/2006 |
| WO | WO 2009/086095 | A2 | 7/2009 |

* cited by examiner

GRINDER, GRINDING METHOD USING THE GRINDER, MANUFACTURING METHOD OF DISPLAY DEVICE USING THE GRINDING METHOD, AND DISPLAY DEVICE MANUFACTURED BY THE MANUFACTURING METHOD

CROSS-REFERENCE TO RELATED APPLICATION

This application claims priority to and the benefit of Korean Patent Application No. 10-2010-0022003, filed in the Korean Intellectual Property Office on Mar. 11, 2010, the entire content of which is incorporated herein by reference.

BACKGROUND

1. Field

Aspects of embodiments of the present invention relate to a grinder and a grinding method using the grinder, and more particularly, to a grinder, a grinding method of a panel using the grinder, a manufacturing method of a display panel using the grinding method, and a display device manufactured by the manufacturing method.

2. Description of the Related Art

Among display devices, flat panel displays are thin display devices that have a flat and thin profile. Such flat panel displays include, for example, a liquid crystal display, an organic light emitting diode display.

A flat panel display includes a display panel for displaying an image. In general, the display panel is formed by cutting a mother panel, formed by bonding together upper and lower substrates having a device for image display, etc., formed thereon, into cells of desired size. The cutting process of the mother panel includes a process of forming a cut groove by a cutting wheel or a process of breaking the cut groove by a breaker, for example.

A display panel having a desired size can be separated from the mother panel by this cutting process. However, horizontal cracks or vertical cracks may occur on edges of a cut surface, and flaws, such as plastic deformation, may be generated at a portion where the cut groove is formed.

To eliminate these flaws, a method of cutting at a reduced insertion depth of a cutting wheel has been devised; however, there is a limitation in repairing cracks by this method. Moreover, a method of grinding edges of a cut surface by a grinding stone, such as diamond, having large grain size and high hardness has been used to eliminate the flaws. This can eliminate cracks caused by cutting, but the surface roughness is increased compared to that before grinding. The increased surface roughness leads to a reduction in the strength of the panel. Thus, this grinding method may fail to achieve desired panel strength.

The above information disclosed in this Background section is only for enhancement of understanding of the background of the described technology and therefore it may contain information that does not form the prior art that is already known in this country to a person of ordinary skill in the art.

SUMMARY

According to an aspect of embodiments of the present invention, a grinder is capable of repairing cracks on edges of a cut surface.

According to another aspect of embodiments of the present invention, a grinding method of a display panel can repair cracks on edges of a cut surface and improve the strength of the panel.

According to further aspects of embodiments of the present invention, a liquid crystal display and an organic light emitting display include edges of a cut surface of a panel which are ground, and a manufacturing method of a liquid crystal display and an organic light emitting diode display includes a grinding method of the edges of the cut surface of the panel.

According to an exemplary embodiment of the present invention, a grinder includes a grinding unit including a grinding surface, and a shaft connected to the grinding unit for rotating the grinding unit. The grinding unit includes polyurethane and a mixture of a repairer and an abrasive, and an angle $\alpha$ between a plane perpendicular to a rotational axis of the shaft and the grinding surface satisfies $1° \leq \alpha \leq 7°$.

In one embodiment, the grinding unit includes 30 to 50% by weight of polyurethane relative to a total weight of the grinding unit and a remaining portion of the total weight includes the mixture, and the mixture includes 50 to 60% by weight of cerium oxide as the repairer relative to a total weight of the mixture.

The abrasive may include at least one of zirconium oxide, silicon carbide, and aluminum oxide.

The grinding surface may have a plurality of pores.

According to another exemplary embodiment of the present invention, a grinding method includes: rotating a grinder including a grinding unit including a grinding surface and a shaft connected to the grinding unit about a rotational axis of the shaft; and moving a panel including first and second substrates bonded together to the grinder and bringing an edge of the panel to the grinding surface of the grinder to grind the edge. An angle $\alpha$ between a plane perpendicular to the rotational axis of the shaft and the grinding surface and an angle $\beta$ between the plane perpendicular to the rotational axis of the shaft and an outer surface of the panel perpendicular to a cut surface of the panel and facing the grinding surface of the grinder satisfy $1° \leq \alpha \leq 7°$ and $10° \leq \beta \leq 60°$, respectively.

A rotational speed of the grinder may be 1000 rpm to 10,000 rpm, and a moving speed of the panel may be 0.1 m/min to 10 m/min.

The grinding unit may include 30 to 50% by weight of polyurethane as a binder relative to a total weight of the grinding unit and a remaining portion of the total weight may include a mixture of a repairer and an abrasive, and the mixture may include 50 to 60% by weight of cerium oxide as the repairer relative to a total weight of the mixture. The abrasive may include at least one of zirconium oxide, silicon carbide, and aluminum oxide.

The grinding surface may have a plurality of pores.

According to another exemplary embodiment of the present invention, a liquid crystal display includes a first substrate including a thin film transistor formed thereon, and a second substrate facing and bonded to the first substrate and including a color filter formed thereon. At least one of edges of outer surfaces opposite surfaces of the first and second substrates facing each other includes a round portion.

A curvature radius of the round portion may be 1/20 to 1/5 of a thickness of the first substrate or second substrate on which the at least one edge is located. Further, the curvature radius of the round portion may be 20 μm to 80 μm.

According to another exemplary embodiment of the present invention, a manufacturing method of a liquid crystal display includes: forming a thin film transistor on a first substrate; forming a color filter on a second substrate; forming a mother panel by bonding the first substrate and the second substrate together; and injecting liquid crystal between the first substrate and the second substrate. The method further includes: cutting along a boundary of cells of the mother panel to separate a panel; and moving the panel to a grinder that is rotatable and includes a grinding unit including a grinding surface and a shaft connected to the grinding unit, and bringing at least one of edges of a cut surface of the panel to the grinding surface of the grinder to grind the at least one edge. An angle $\alpha$ between a plane perpendicular to a rotational axis of the shaft and the grinding surface and an angle $\beta$ between the plane perpendicular to the rotational axis of the shaft and an outer surface of the panel perpendicular to the cut surface of the panel and facing the grinding surface of the grinder satisfy $1° \leq \alpha \leq 7°$ and $10° \leq \beta \leq 60°$, respectively.

A diameter of the grinding unit of the grinder may be smaller than a length of the at least one edge to be ground.

According to another exemplary embodiment of the present invention, an organic light emitting diode display includes a first substrate including a thin film transistor and an organic light emitting diode formed thereon, and a second substrate facing and bonded to the first substrate. At least one of edges of an outer surface of the first substrate opposite a surface facing the second substrate includes a round portion.

A curvature radius of the round portion may be 1/20 to 1/5 of a thickness of the first substrate. Further, the curvature radius of the round portion may be 20 μm to 80 μm.

The second substrate may include glass, and at least one of edges of an outer surface of the second substrate opposite a surface facing the first substrate may include a round portion.

The second substrate may be formed of an encapsulation layer including a stack of a plurality of thin films.

According to another exemplary embodiment of the present invention, a manufacturing method of an organic light emitting diode display includes sequentially forming a thin film transistor and an organic light emitting diode on a first substrate, and forming a mother panel by bonding a second substrate onto the first substrate. Further, the method includes cutting along a boundary of cells of the mother panel to separate a panel, and moving the panel to a grinder that is rotatable and includes a grinding unit including a grinding surface and a shaft connected to the grinding unit, and bringing at least one of edges of a cut surface of the first substrate to the grinding surface of the grinder to grind the at least one edge. An angle $\alpha$ between a plane perpendicular to a rotational axis of the shaft and the grinding surface and an angle $\beta$ between the plane perpendicular to the rotational axis of the shaft and an outer surface of the panel perpendicular to a cut surface of the panel and facing the grinding surface of the grinder satisfy $1° \leq \alpha \leq 7°$ and $10° \leq \beta \leq 60°$, respectively.

A diameter of the grinding unit of the grinder may be smaller than a length of the at least one edge of the first substrate to be ground.

The second substrate may include glass, and the first substrate and the second substrate may be bonded together by a sealant applied onto the first substrate or the second substrate. The method may further include bringing at least one of edges of a cut surface of the second substrate into contact with the grinding surface of the grinder to grind the at least one edge of the cut surface of the second substrate. A diameter of the grinding unit of the grinder may be smaller than a length of the at least one edge of the second substrate to be ground.

The second substrate may be formed of an encapsulation layer including a stack of a plurality of organic and inorganic films, and the first substrate and the second substrate may be bonded together by curing the encapsulation layer with ultraviolet light.

According to aspects of embodiments of the present invention, flaws such as cracks generated on the edges of a cut surface after cutting a panel can be eliminated or reduced by grinding the panel uniformly and efficiently. Moreover, the strength of the panel can be maintained by decreasing the surface roughness of the edges of the cut surface. Further, yield can be improved by suppressing or reducing defects in products in the manufacturing process.

BRIEF DESCRIPTION OF THE DRAWINGS

The above and other features and advantages of embodiments of the present invention will become more apparent to those of ordinary skill in the art by describing in detail some exemplary embodiments of the present invention with reference to the attached drawings.

DETAILED DESCRIPTION

Figure 1:
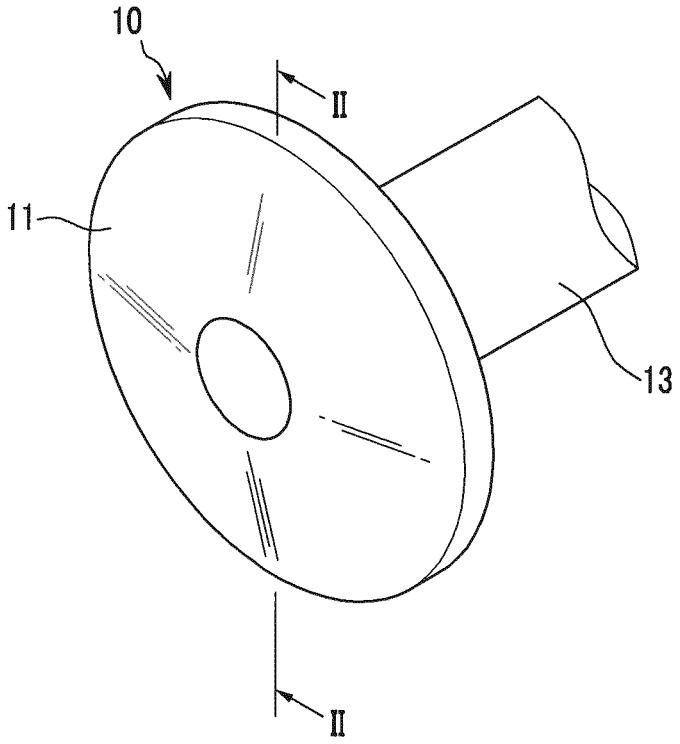
FIG. 1 is a perspective view of a grinder according to an exemplary embodiment of the present invention.

In the following detailed description, some exemplary embodiments of the present invention are shown and described, by way of illustration. As those skilled in the art would realize, the described exemplary embodiments may be modified in various ways without departing from the spirit or scope of the present invention. Rather, these exemplary embodiments are provided by way of example for understanding of the invention and to convey the scope of the invention to those skilled in the art.

In the following description of some exemplary embodiments and in the drawings, like reference numerals designate like elements throughout. Further, the size and/or thickness of some components shown in the drawings may be shown for clarity and ease of description, and the present invention is not limited to those shown in the drawings. Further, in the drawings, the size and/or thickness of layers, regions, etc., may be exaggerated for clarity. Also, it will be understood that when an element such as a layer, film, region, or substrate is referred to as being "on" another element, it may be directly on the other element, or intervening elements may also be present.

Figure 2:
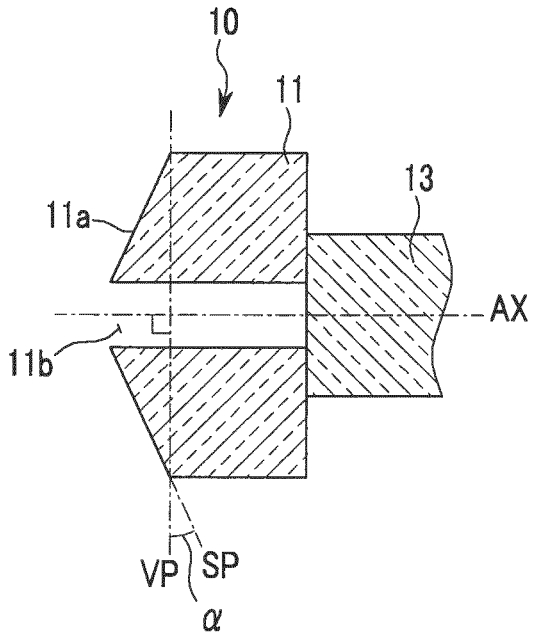
FIG. 2 is a cross-sectional view of the grinder of FIG. 1 taken along line II-II.

FIG. 1 is a perspective view of a grinder according to an exemplary embodiment of the present invention, and FIG. 2 is a cross-sectional view of the grinder of FIG. 1 taken along line II-II. The grinder according to an exemplary embodiment will be described with reference to these drawings.

The grinder 10 according to an exemplary embodiment includes a grinding unit 11 and a shaft 13. The grinding unit 11 includes a grinding surface 11 a for directly contacting an object to be ground and substantially grinding the object, and a generally cylindrical groove 11*b* formed inside. The shaft 13 transmits torque to the grinding unit 11 to enable the grinding surface 11*a* to perform a grinding operation by high-speed rotation. Specifically, the shaft 13 is connected to a motor (not shown) driven by an external power source and rotates, thus transmitting torque to the grinding unit 11.

Referring to FIG. 2, the grinding surface 11*a* in an exemplary embodiment is not planar, but is inclined at a certain angle, relative to a plane VP that is vertical, or perpendicular, to a rotational axis AX. That is, an end of the grinding unit 11 in an exemplary embodiment has a generally conical shape in which the grinding surface 11*a* is inclined. This provides uniform or substantially uniform contact between the object to be ground and the grinding surface 11*a* during the grinding operation, and accordingly improves grinding efficiency and product yield, which will be described later in detail.

As such, in an exemplary embodiment, a slope SP extending from the grinding surface 11*a* has a predetermined angle $\alpha$ with respect to the plane VP perpendicular to the rotational axis AX. The angle $\alpha$ between the slope SP and the plane VP has a value within the range of 1° to 7°. If the angle $\alpha$ is less than 1°, the grinding surface 11*a* has a nearly planar shape, so that the inside of the grinding surface 11*a* may be abraded in an early stage and a stepped portion may be formed there. If the angle $\alpha$ exceeds 7°, the uniformity of grinding may be degraded. Therefore, the angle $\alpha$ between the slope SP and the plane VP, in an exemplary embodiment, is between 1° and 7°.

The grinding unit 11, in one embodiment, is formed of a material prepared by mixing a mixture of a repairer and an abrasive with a binder. In an exemplary embodiment, polyurethane is used as the binder. As pores can be formed in the grinding surface 11*a* by using polyurethane as the binder, the grinding surface 11*a* of a softer material can be attained. As a result, the problem of rough cross-sections caused by grinding due to high hardness when forming the grinder from diamond, etc., can be avoided.

The binder formed of polyurethane may be included at 30 to 50% by weight. In an exemplary embodiment, the grinding unit 11 is formed of 30 to 50% by weight of polyurethane, and the remaining portion includes the mixture of the repairer and the abrasive.

The repairer for repairing cracks, etc., of the object to be ground may be cerium oxide ($CeO_2$). Moreover, the abrasive to be mixed to increase the grinding effect may include at least one of zirconium oxide ($ZrO_2$), silicon carbide (SiC), and aluminum oxide ($Al_2O_3$). In an exemplary embodiment, the mixture of the repairer and the abrasive includes 50 to 60% by weight of the repairer, that is, cerium oxide. Moreover, zirconium oxide, silicon carbide, and aluminum oxide, which can be used as the abrasive, may be mixed together, such as 10% by weight or more of each.

As such, by using the mixture of the repairer including cerium oxide and the abrasive including zirconium oxide together with the binder including polyurethane, cracks can be repaired, sufficient grinding effect can be obtained, and the grinding unit 11 having softness due to the pores can be formed.

Figure 3:
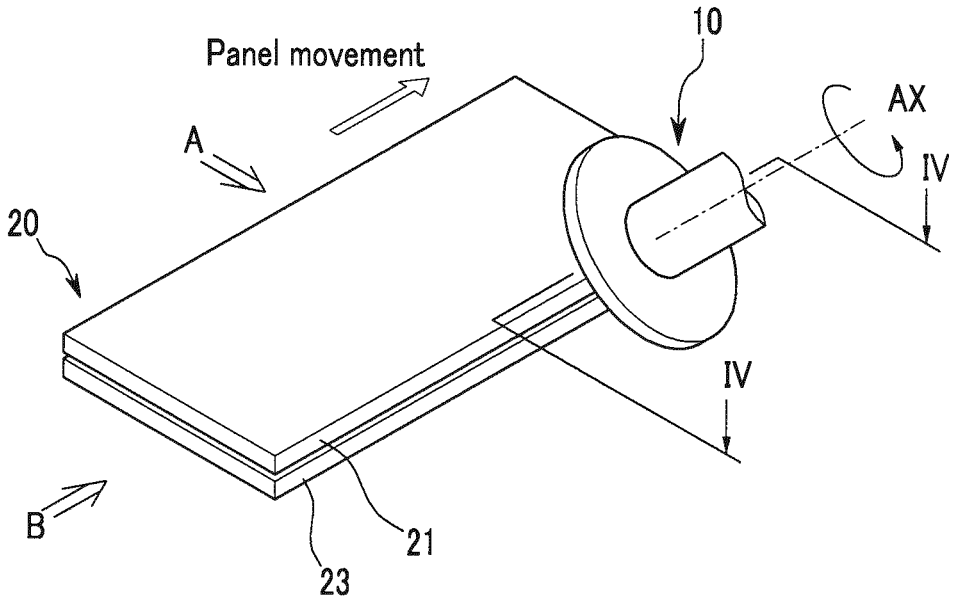
FIG. 3 is a perspective view showing a process of grinding an edge of a panel according to an exemplary embodiment of the present invention.
Figure 4A:
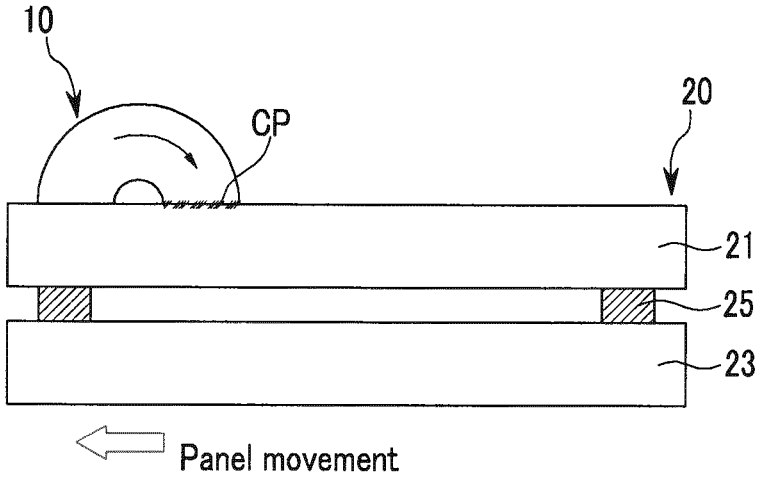
FIGS. 4A and 4B are side views showing the process of grinding the edge of the panel as viewed in directions A and B of FIG. 3.
Figure 4B:
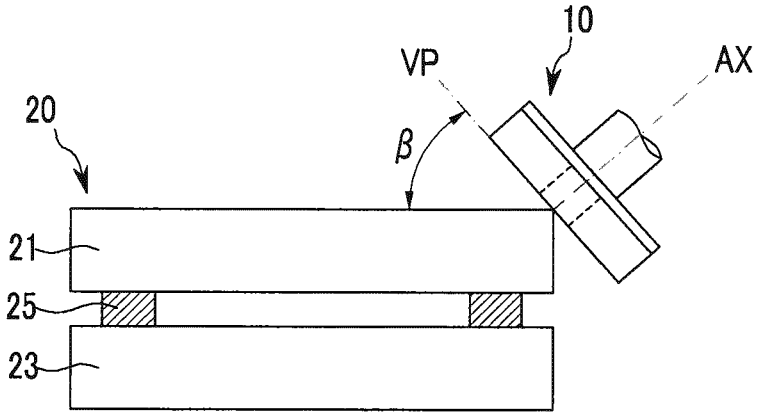
Figure 4C:
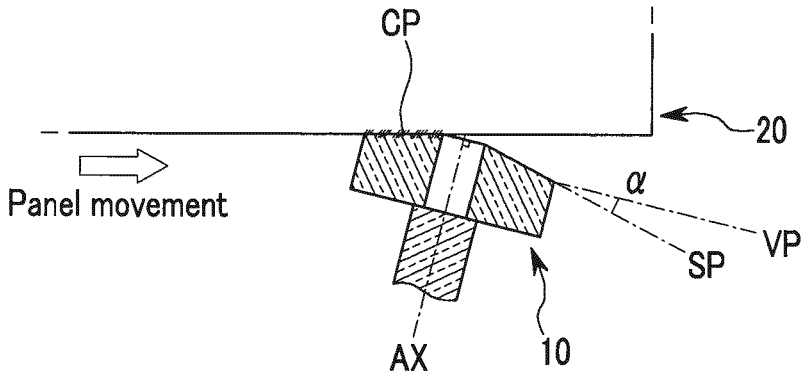
FIG. 4C is a cross-sectional view taken along line IV-IV of FIG. 3.

FIG. 3 is a perspective view showing a process of grinding an edge of a panel according to an exemplary embodiment of the present invention, FIGS. 4A and 4B are side views as viewed in directions A and B of FIG. 3, and FIG. 4C is a cross-sectional view taken along line IV-IV of FIG. 3. A grinding method according to an exemplary embodiment of the present invention will now be described with reference to these drawings.

Referring to FIG. 3, in an exemplary embodiment, a panel 20 is formed by cutting a mother panel having an upper substrate 21 and a lower substrate 23 bonded together into cells, and the panel 20 is moved to a grinder 10 rotating at a high speed around a rotational axis AX and undergoes a grinding process. The grinder 10, according to an exemplary embodiment, has the shape and material described above with respect to FIGS. 1 and 2. That is, the grinding surface is inclined at an angle $\alpha$ of 1° to 7° with respect to the plane perpendicular to the rotational axis AX, and the grinding unit is formed of a binder including polyurethane, a repairer including cerium oxide, and an abrasive including zirconium oxide.

As described above, the grinding surface of the grinder 10 is inclined at a predetermined angle $\alpha$ with respect to the plane perpendicular to the rotational axis AX, whereby the grinding surface and an edge of the panel 20 are brought into direct contact with each other on only one side with respect to the center of the grinding surface. Referring to FIGS. 4A to 4C, since the grinding surface of the grinder 10 forms a slope SP having a predetermined angle $\alpha$ with respect to the plane VP vertical, or perpendicular, to the rotational axis AX, it has a contact portion CP which, as the panel 20 is moved, brings the edge of the panel 20 and the grinding surface into contact with each other only on one side of the grinding unit. The grinder 10 rotates around the rotational axis AX to thus grind the edge of the panel 20 contacting the grinder 10, whereby the grinding surface is brought into substantially uniform contact with the edge of the panel 20 at the contact portion CP.

In a case of a grinder having a grinding surface formed as a plane perpendicular to the rotational axis, unlike in the grinder 10 described above, as the panel is moved, the edge of the panel is moved to the planar grinding surface. As a result, contact portions are formed at both sides with respect to the center of the grinding surface, thereby performing grinding simultaneously on both sides. In this case, an excessive load may be applied to the inside of the grinding surface, and accordingly the inside of the grinding surface may be abraded first and a stepped portion may be formed. In the case where a stepped portion is formed, a process for planarizing the grinding surface is required. Moreover, irregularities may be formed on the edges of the panel because grinding takes place simultaneously on both sides having different rotational directions with respect to the center of the grinding surface.

By contrast, using the grinder 10 according to the above-described exemplary embodiment, a grinding operation may be performed uniformly over the grinding surface since the grinding surface of the grinder 10 is formed with the slope SP. Therefore, the problem of formation of a stepped portion at a particular position of the grinding surface can be avoided. Further, the grinding operation is performed in a constant direction because contact occurs on only one side of the grinding surface, whereby the problem of irregularities on the edges of the panel can be suppressed or reduced. As a result, the life-span of the grinder can be extended, and the yield of products can be improved by reducing defects.

In addition, a generally cylindrical groove is formed at the center of the grinding unit, and this prevents or substantially prevents application of an excessive load during the grinding operation. Although illustrated in FIG. 4A and 4B with respect to a structure in which the upper substrate 21 and the lower substrate 23 are bonded together by a sealing member 25, embodiments of the present invention are not to be construed as being limited thereto but, rather, the upper substrate 21 and the lower substrate 23 may be bonded together in various ways.

In an exemplary embodiment, referring to FIG. 4B, the panel 20 is moved toward the grinder 10 so that the plane VP vertical, or perpendicular, to the rotational axis AX of the grinder 10 has a predetermined angle β with respect to the top surface of the panel 20 having the edges to be ground. If the angle β between the plane VP perpendicular to the rotational axis AX and the top surface of the panel 20 is less than 10°, the grinding surface of the grinder 10 is much abraded, and an excessive pressure is applied to the top surface of the panel 20 so that defects may be generated in the grinding process. On the other hand, if the angle β exceeds 60°, additional parts other than the edges of the top surface of the panel 20 desired to be ground may be ground. Therefore, in an exemplary embodiment, the angle β between the plane VP vertical, or perpendicular, to the rotational axis AX and the top surface of the panel 20 may be between 10° and 60°.

In an exemplary embodiment, the grinder 10 is rotated at a high speed in order to achieve sufficient grinding, whereas the panel 20 is moved at a low speed. In an exemplary embodiment, the rotational speed of the grinder 10 and the moving speed of the panel 20 may be within a predetermined range for considerations of grinding efficiency.

If the rotational speed of the grinder 10 is less than 1000 rpm, the edge portion of the panel 20 may not be sufficiently ground. On the other hand, if the rotational speed of the grinder 10 exceeds 10,000 rpm, vibration may be generated due to the high rotational speed and thereby make it difficult to perform uniform grinding. Accordingly, in an exemplary embodiment, the rotational speed of the grinder 10 is between 1000 rpm and 10,000 rpm.

In an exemplary embodiment, the moving speed of the panel 20 is within a range of 0.1 m/min to 10 m/min. In general, the lower the moving speed of the panel 20, the more sufficient and uniform the grinding is. However, if the moving speed of the panel 20 is less than 0.1 m/min, it may be difficult to control the grinding process, and production yield may be reduced due to the low processing speed. On the contrary, if the moving speed of the panel 20 exceeds 10 m/min, sufficient grinding will not be obtained and, accordingly, the grinding efficiency may be decreased and defects may be generated.

As such, in an exemplary embodiment, the rotational speed of the grinder 10 and the moving speed of the panel 20 may be selected to desired values within the above-defined ranges for considerations of grinding efficiency, processing speed, etc.

Figure 5A:
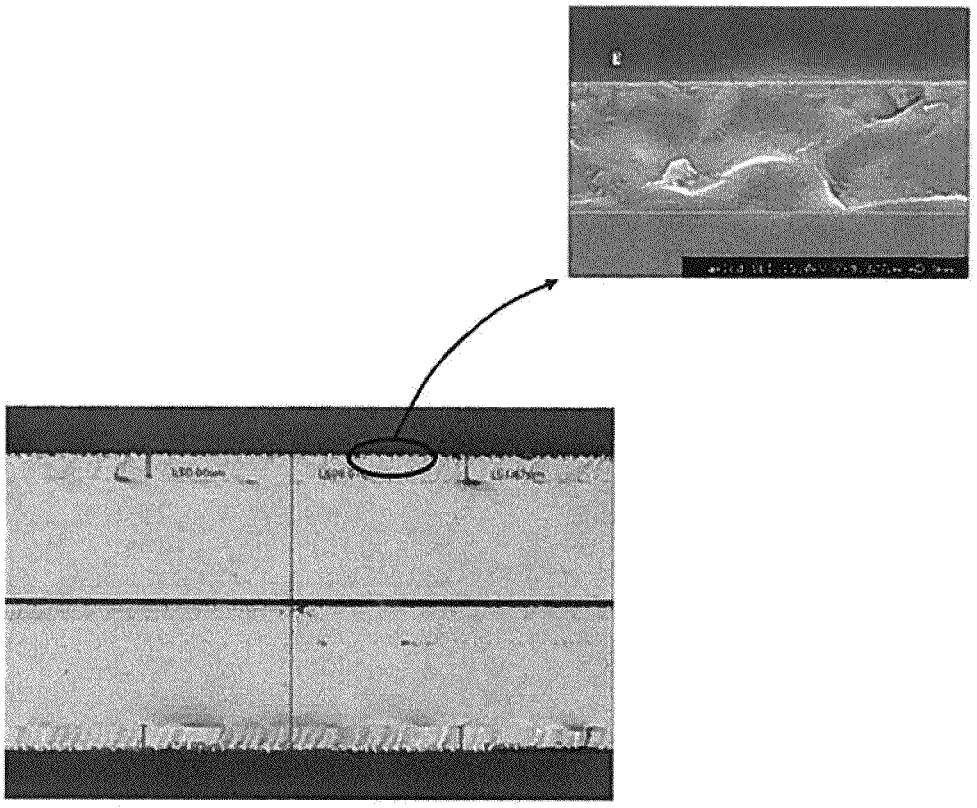
FIGS. 5A to 5C are photographs comparing the edge of a panel after a grinding process according to an exemplary embodiment of the present invention with that of a comparative example.
Figure 5B:
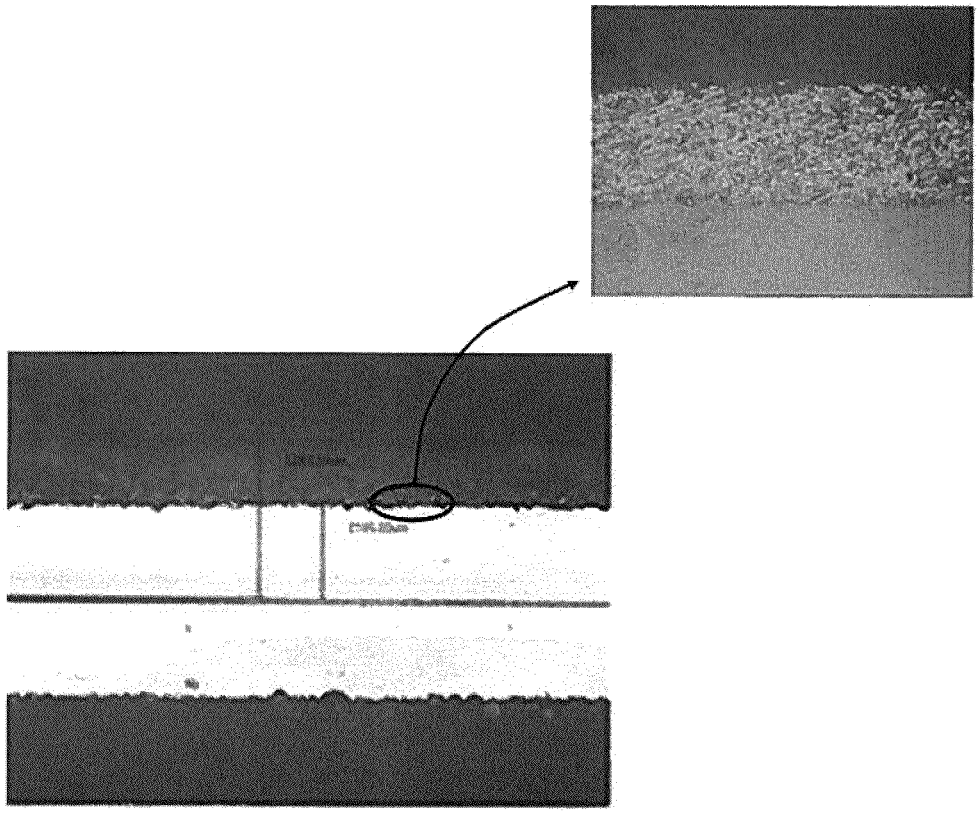
Figure 5C:
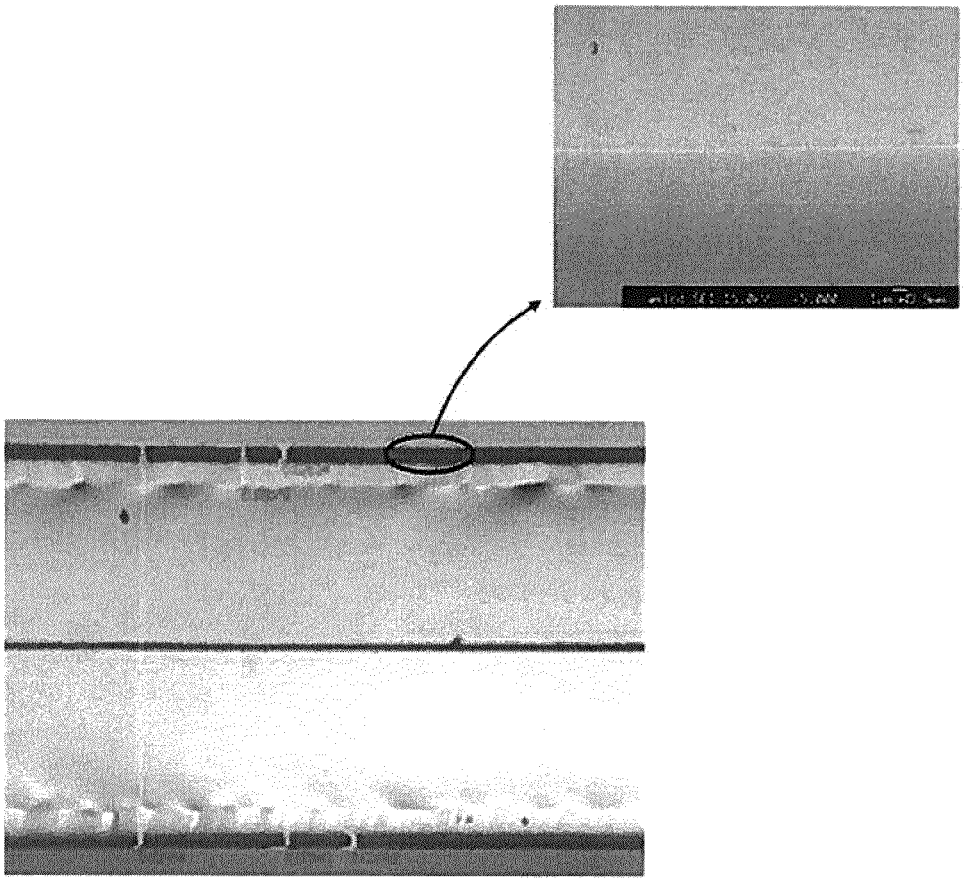

FIGS. 5A to 5C are photographs comparing the edge of a panel after a grinding process according to an exemplary embodiment of the present invention with that of a comparative example. The effects of the grinder and the grinding method using the grinder according to an exemplary embodiment will be described with reference to these photographs.

FIG. 5A is an enlarged photograph showing one cut surface of the panel, obtained by forming a cut groove on a mother panel having the upper and lower substrates bonded together by a cutting wheel and breaking and cutting the cut groove, and an edge portion of the cut surface. From this, it can be seen that a plurality of irregular flaws, such as cracks, are formed on the edge portion where the cut groove is formed and broken.

FIG. 5B is an enlarged photograph showing a cut surface, obtained after grinding the edge of the cut surface of FIG. 5A by a grinding stone made of diamond, and the edge portion thereof, whereby it can be seen that visible cracks are fewer compared with those of FIG. 5A, but surface roughness is increased. The increase in surface roughness causes degradation in the strength of the substrates, and hence a grinding process using a grinding stone made of diamond may bring about the problem of degradation in the strength of the substrates or panel.

FIG. 5C is an enlarged photograph showing a cut surface, obtained after cutting a mother panel and grinding the edge of the cut surface of the panel by the grinder according to an exemplary embodiment of the present invention, and the edge portion thereof. After grinding the edge of the panel by the grinder according to an embodiment of the present invention, irregular flaws such as cracks are eliminated or reduced, and also, surface roughness is not increased, unlike the grinding operation using a grinding stone made of diamond. From this, it can be seen that the above-described effects can be obtained by forming the grinder according to an exemplary embodiment to have a structure where the grinding surface has a slope and is made of a soft material, relative to the grinding stone made of diamond, by including polyurethane, cerium oxide, and an abrasive.

The panel cutting process may be performed by forming a cut groove on both substrates by a cutting wheel and then breaking it, whereby an inner edge portion of the cut surface that does not contact the cutting wheel is substantially perpendicular to the top and bottom surfaces of the panel. Accordingly, flaws such as cracks are not generated on the inner edges of the cut surface, and thus no separate grinding operation may be required.

Although not shown in the photographs, the smaller the thickness of the panel, the more fragile the panel is to flaws, such as cracks caused by cutting. Hence, a greater effect of the grinder and the grinding method according to embodiments of the present invention can be expected on medium and small-sized panels having relatively small thickness than on large-sized panels.

Hereinafter, various flat panel displays formed by the grinder and the grinding method using the same according to embodiments of the present invention and a manufacturing method thereof will be described.

FIGS. 6A to 6D show a manufacturing process of a liquid crystal display according to an exemplary embodiment of the present invention. The liquid crystal display and a manufacturing method thereof according to an exemplary embodiment will be described with reference to FIGS. 6A to 6D.

Figure 6A:
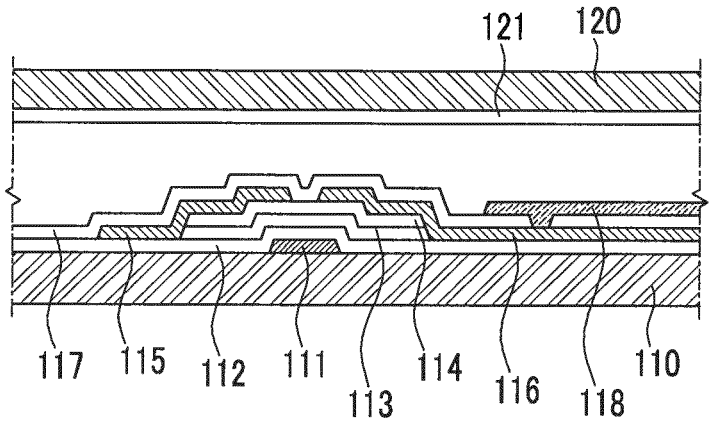
FIGS. 6A to 6D are views showing a manufacturing process of a liquid crystal display according to an exemplary embodiment of the present invention.

A liquid crystal display panel of the liquid crystal display according to an exemplary embodiment includes a TFT substrate 110 having a thin film transistor TFT formed thereon and a CF substrate 120 having a color filter CF formed thereon. FIG. 6A shows an enlarged part of a display area of the TFT substrate 110 and the CF substrate 120. Referring to FIG. 6A, a gate electrode 111, a gate insulating layer 112, a semiconductor layer 113, and a resistant contact layer 114 are sequentially formed on the TFT substrate 110. Moreover, a source electrode 115 and a drain electrode 116 are formed on the resistant contact layer 114, a protective layer 117 is formed thereon, and a pixel electrode 118 is formed on the protective layer 117 and connected to the drain electrode 116. Further, a color filter (not shown) and a common electrode 121 for applying a voltage to the CF substrate 120 are formed on the CF substrate 120. Also, the internal structure of the liquid crystal display panel described above is shown as one example for purposes of illustration, and the scope of the invention is not limited to this internal structure and may be applied to liquid crystal display panels having variously modified structures.

After the TFT substrate 110 and the CF substrate 120 are prepared as above, a mother panel is formed by applying a sealant onto a non-display area on the outside of the display area of the CF substrate 120 and bonding the substrates 110, 120 together. Afterwards, the sealant is cured by UV light exposure or the like to form a sealing member 130, and liquid crystal is injected between the TFT substrate 110 and the CF substrate 120.

Figure 6B:
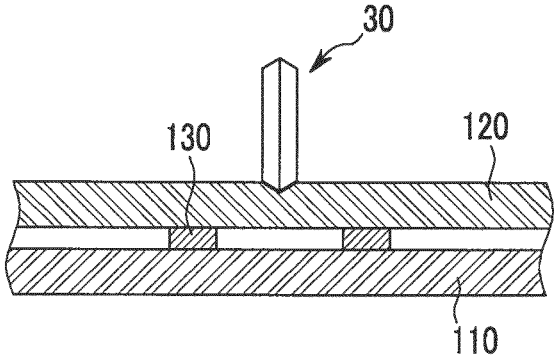

Referring to FIG. 6B, a cut groove is formed along a boundary of cells on the mother panel using a cutting wheel 30, and the cut groove is broken, thereby separating a panel. According to the process, the cut groove may be formed on at least one of the TFT substrate 110 and the CF substrate 120. While an exemplary embodiment has been described with respect to a case where the sealing member 130 is formed adjacent to the boundary of the cells, the sealing member 130 may be formed across the two neighboring cells so as to overlap with the boundary of the cells. In this case, the process of cutting the mother panel to separate the panel is performed by cutting the top of the sealing member to form a cut groove and breaking the cut groove.

Figure 6C:
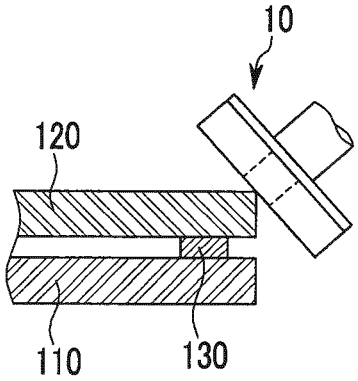

Referring to FIG. 6C, the mother panel is cut to separate the panel, and then edges of the cut surface are ground using the grinder 10. The grinder 10 shown in FIG. 6C has the same shape and material as described above with respect to FIGS. 1 and 2. While in one exemplary embodiment the grinder 10 includes a grinding unit having a smaller diameter than a length of one side of the panel in order to easily control the grinding process, embodiments of the present invention are not limited thereto, and the relative sizes of the grinder and the panel may be varied according to a desired size of the panel and other process conditions.

Inner edges of the cut surface where the TFT substrate 110 and the CF substrate 120 are adjacent to each other do not need to be ground because flaws such as cracks formed there are not a significant problem. Outer edges of the cut surface of the TFT substrate 110 and the CF substrate 120 need to be ground in order to eliminate flaws, such as cracks, and improve strength. Accordingly, in an exemplary embodiment, a grinding operation is performed along the outer edges of the cut surface of the TFT substrate 110 and the CF substrate 120. In an exemplary embodiment, an edge where flaws, such as cracks, are a significant problem, among the outer edges of the cut surface of the TFT substrate 110 and the CF substrate 120, can be selectively ground and, accordingly, one to eight edges can be ground.

By performing the grinding operation using the grinder 10 as described above, the manufacturing of the liquid crystal display panel is completed, and thereafter a printed circuit board, a backlight assembly, and a mold frame containing the backlight assembly are coupled thereto, thereby obtaining a liquid crystal display according to an exemplary embodiment of the present invention.

Figure 6D:
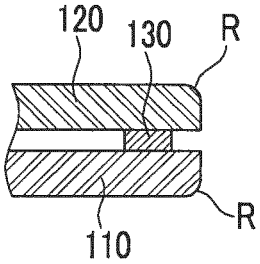

A round portion R, as shown in FIG. 6D, is formed on an outer edge that is ground. In an exemplary embodiment, the curvature radius of the round portion has a value of 1/20 to 1/5 of the thickness of the substrate having the round portion R formed thereon. As defined herein, the term "round" in describing the round portion R includes a circularly or elliptically contoured cross-section or a polygonally contoured cross-section with three or more straight lines. That is, the formation of the round portion includes the case where a flat surface is formed and connected between two adjacent planes, as well as the case where a curve is formed between two adjacent planes. Moreover, as used herein, the "curvature radius" of the round portion R indicates the radius of curvature of a cross-section when the cross-section is circular or elliptical, and indicates the radius of curvature of an ellipse or circle simultaneously contacting three or more sides when the cross-section is polygonal.

According to the above-described manufacturing method of the liquid crystal display, by grinding the edges of the cut surface using the grinder 10, flaws such as cracks generated on the edge portion caused by cutting can be eliminated or reduced, and the strength of the panel can be improved. Further, the smaller the thickness of the panel, the more susceptible the panel is to flaws, such as cracks, caused by cutting. Hence, a greater effect can be expected on medium and small-sized panels.

FIGS. 7A to 7D show a manufacturing process of an organic light emitting diode display according to an exemplary embodiment of the present invention. The organic light emitting diode display and a manufacturing method thereof according to an exemplary embodiment will now be described with reference to FIGS. 7A to 7D.

Figure 7A:
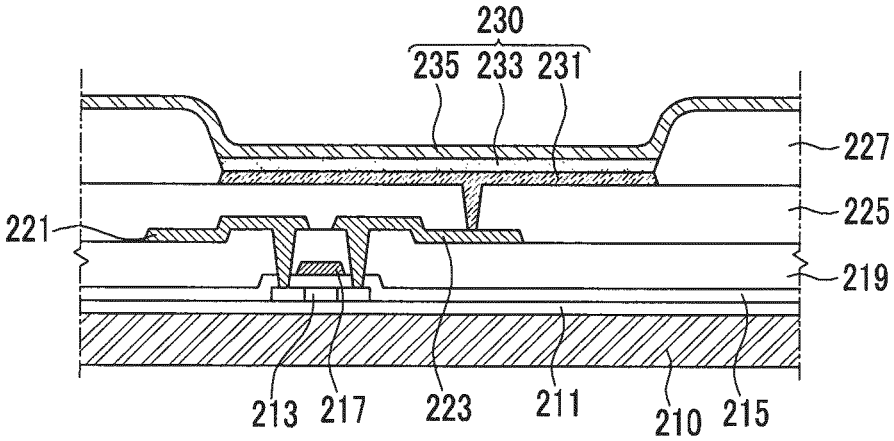
FIGS. 7A to 7D are views showing a manufacturing process of an organic light emitting diode display according to an exemplary embodiment of the present invention.

An organic light emitting display panel of an organic light emitting diode display according to an exemplary embodiment includes a display substrate 210 having a thin film transistor and an organic light emitting diode 230 formed thereon and an encapsulation substrate 240 facing the display substrate 210. FIG. 7A shows an enlarged part of a display area of the display substrate 210. Referring to FIG. 7A, a buffer layer 211, a driving semiconductor layer 213, a gate insulation layer 215, a gate electrode 217, and an interlayer insulating layer 219 are sequentially formed on the display substrate 210, and a source electrode 221 and a drain electrode 223 are formed on the interlayer insulating layer 219 and respectively connected to source and drain regions of the driving semiconductor layer 213, thereby forming the thin film transistor. A planarization layer 225 and a pixel defining layer 227 are formed on the interlayer insulating layer 219, the source electrode 221, and the drain electrode 223, and a pixel electrode 231, an organic emission layer 233, and a common electrode 235 to be connected to the drain electrode 223 via a contact hole are sequentially formed on the planarization layer 225, thereby forming the organic light emitting diode 230. According to the driving method of the organic light emitting diode display, the pixel electrode 231 may be a positive electrode and the common electrode 235 may be a negative electrode, or vice versa. Also, the internal structure of the organic light emitting display panel described above is shown as one example for purposes of illustration, and the scope of the invention is not limited to this internal structure and may be applied to organic light emitting display panels having variously modified structures.

After the display substrate 210 having the thin film transistor and the organic light emitting diode 230 formed thereon and the encapsulation substrate 240 made of glass are prepared as described above, a mother panel is formed by applying a sealant to at least one of the two substrates and bonding both of the substrates 210, 240 together. Afterwards, the sealant is cured by UV light exposure or the like to form a sealing member 250.

After the display substrate 210 and the encapsulation substrate 240 are bonded together, the panel is separated and ground by a similar method to the manufacturing process of the liquid crystal display described above.

Figure 7B:
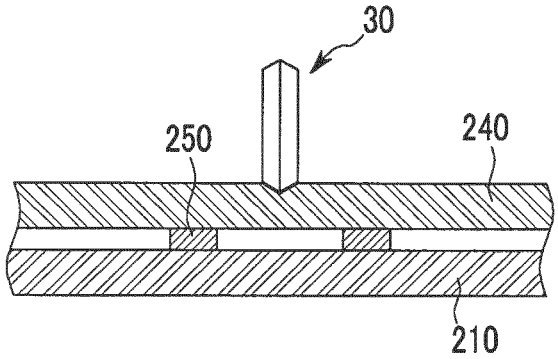

Referring to FIG. 7B, after the display substrate 210 and the encapsulation substrate 240 are bonded together, a cut groove is formed along the boundary of cells on the mother panel using the cutting wheel 30, and the cut groove is broken, thereby separating a panel. According to the process, the cut groove may be formed on at least one of the display substrate 210 and the encapsulation substrate 240. While an exemplary embodiment has been described with respect to a case where the sealing member 250 is formed adjacent to the boundary of the cells, the sealing member 250 may be formed across the two neighboring cells so as to overlap with the boundary of the cells. In this case, the process of cutting the mother panel to separate the panel is performed by cutting the top of the sealing member to form a cut groove and breaking the cut groove.

Figure 7C:
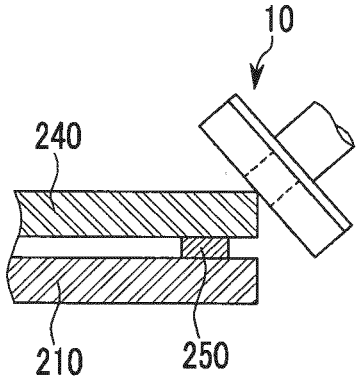

Referring to FIG. 7C, the mother panel is cut to separate the panel, and then edges of the cut surface are ground using the grinder 10. The grinder 10 has the same shape and material as described above with respect to FIGS. 1 and 2. While in an exemplary embodiment the grinder 10 includes a grinding unit having a smaller diameter than a length of one side of the panel in order to easily control the grinding process, embodiments of the present invention are not limited thereto, and the relative sizes of the grinder and the panel may be varied according to a desired size of the panel and other process conditions.

As discussed above with respect to the liquid crystal display panel, inner edges of the cut surface where the display substrate 210 and the encapsulation substrate 240 are adjacent to each other do not need to be ground because flaws, such as cracks, formed there are not a significant problem. However, outer edges of the cut surface of the display substrate 210 and the encapsulation substrate 240 need to be ground in order to eliminate or reduce flaws, such as cracks, and improve strength. Accordingly, in an exemplary embodiment, a grinding operation is performed along the outer edges of the cut surface of the display substrate 210 and the encapsulation substrate 240. In an exemplary embodiment, an edge where flaws, such as cracks, are a significant problem, among the outer edges of the cut surface of the display substrate 210 and the encapsulation substrate 240, can be selectively ground and, accordingly, one to eight edges can be ground.

By performing the grinding operation using the grinder 10 as described above, the manufacturing of the organic light emitting display panel is completed, and thereafter a printed circuit board, a frame, etc., are coupled thereto, thereby obtaining an organic light emitting diode display according to an exemplary embodiment of the present invention.

Figure 7D:
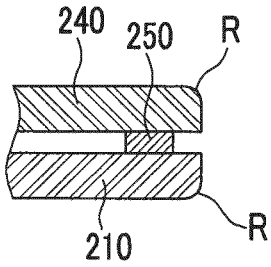

A round portion R, as shown in FIG. 7D, is formed on an outer edge that is ground using the grinder 10. In an exemplary embodiment, the curvature radius of the round portion has a value of 1/20 to 1/5 of the thickness of the substrate having the round portion R formed thereon.

According to the manufacturing method of the organic light emitting diode display of an exemplary embodiment, by grinding the edges of the cut surface using the grinder 10, flaws, such as cracks, generated on the edge portion caused by cutting can be eliminated or reduced, and the strength of the panel can be improved. Further, the smaller the thickness of the panel, the more susceptible the panel is to flaws, such as cracks, caused by cutting. Hence, a greater effect can be expected on medium and small-sized panels.

FIGS. 8A to 8D show a manufacturing process of an organic light emitting diode display according to another exemplary embodiment of the present invention. The organic light emitting diode display and a manufacturing method thereof according to another exemplary embodiment will now be described with reference to FIGS. 8A to 8D.

An organic light emitting display panel of the organic light emitting diode display according to another exemplary embodiment has a similar structure to that of the organic light emitting display panel of FIGS. 7A to 7D. That is, referring to FIG. 8A, a buffer layer 311, a driving semiconductor layer 313, a gate insulation layer 315, a gate electrode 317, and an interlayer insulating layer 319 are sequentially formed on a display substrate 310, and a source electrode 321 and a drain electrode 323 are formed on the interlayer insulating layer 319 and respectively connected to source and drain regions of the driving semiconductor layer 313, thereby forming the thin film transistor. A planarization layer 325 and a pixel defining layer 327 are formed on the interlayer insulating layer 319, the source electrode 321, and the drain electrode 323, and a pixel electrode 331, an organic emission layer 333, and a common electrode 335 to be connected to the drain electrode 323 via a contact hole are sequentially formed on the planarization layer 325, thereby forming an organic light emitting diode 330. Also, the internal structure of the organic light emitting display panel described above is shown as one example for purposes of illustration, and the scope of the invention is not limited to this internal structure and may be applied to organic light emitting display panels having variously modified structures.

The organic light emitting display panel according to an exemplary embodiment has an encapsulation layer 340 including a stack of an organic film 340*a* and an inorganic film 340*b* formed as a structure for sealing the display substrate 310. Specifically, in one embodiment, the organic film 340*a* is formed of ultraviolet curing material and the organic film 340*a* and the inorganic film 340*b* are stacked, and then the organic film 340*a* is cured by ultraviolet irradiation, thereby forming the encapsulation layer 340. Hereupon, an ultraviolet blocking film may be further formed between the organic light emitting diode 330 and the encapsulation layer 340 in order to prevent or substantially prevent a change in the characteristics of the organic light emitting diode display caused by ultraviolet irradiation. Further, while an exemplary embodiment has been described with respect to an example of a double-layer structure of the organic film 340*a* and the inorganic film 340*b*, embodiments of the present invention are not limited thereto but, rather, may have a multilayer structure of two or more layers in which a plurality of organic and inorganic films are stacked.

After the encapsulation layer 340 is bonded onto the display substrate 310, the panel is separated and ground by a similar method to the manufacturing process of the liquid crystal display described above with respect to FIGS. 7A to 7D.

Figure 8A:
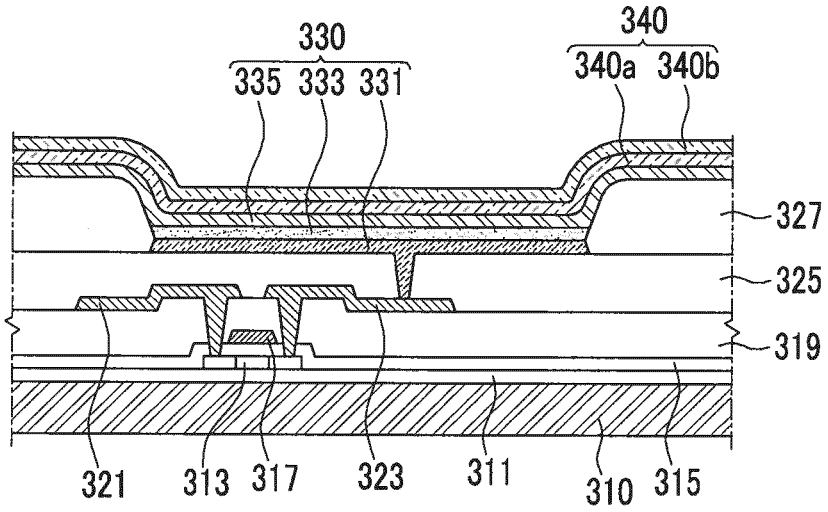
FIGS. 8A to 8D are views showing a manufacturing process of an organic light emitting diode display according to another exemplary embodiment of the present invention.
Figure 8B:
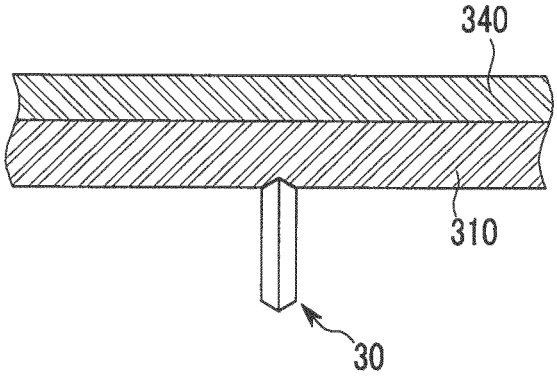

Referring to FIG. 8B, after the encapsulation layer 340 is bonded onto the display substrate 310, a cut groove is formed along the boundary of cells on the mother panel using the cutting wheel 30, and the cut groove is broken, thereby separating a panel. At this point, the cut groove is formed along the boundary of the cells on the display substrate 310.

Figure 8C:
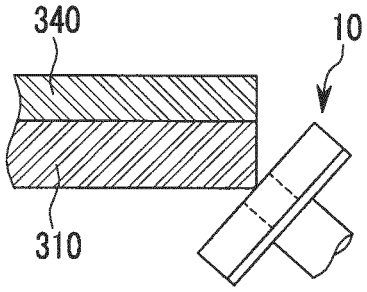

Referring to FIG. 8C, the mother panel is cut to separate the panel, and then edges of the cut surface are ground using the grinder 10. The grinder 10 has the same shape and material as described above with respect to FIGS. 1 and 2. While, in an exemplary embodiment, the grinder 10 includes a grinding unit having a smaller diameter than a length of one side of the panel in order to easily control the grinding process, embodiments of the present invention are not limited thereto, and the relative sizes of the grinder and the panel may be varied according to a desired size of the panel and other process conditions.

In an exemplary embodiment, the encapsulation layer 340 is formed by stacking the organic film 340*a* and the inorganic film 340*b*, so that the edge on the encapsulation layer 340, among the edges of the cut surface, does not need to be ground because flaws, such as cracks, formed there are not a significant problem. However, edges of the cut surface of the display substrate 310 need to be ground in order to eliminate flaws, such as cracks, and improve strength and, therefore, a grinding operation is performed along the edges of the cut surface of the display substrate 310. In an exemplary embodiment, an edge where flaws, such as cracks, are a significant problem, among the edges of the cut surface of the display substrate 310, can be selectively ground and, accordingly, one to four edges can be ground.

By performing the grinding operation using the grinder 10, as described above, the manufacturing of the organic light emitting display panel is completed and, thereafter, a printed circuit board, a frame, etc., are coupled thereto, thereby obtaining an organic light emitting diode display according to an exemplary embodiment of the present invention.

Figure 8D:
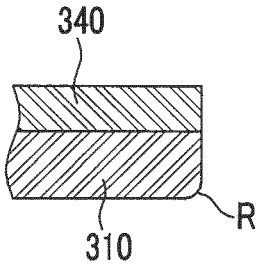

A round portion R, as shown in FIG. 8D, is formed on an edge of the display substrate 310 that is ground using the grinder 10. In an exemplary embodiment, the curvature radius of the round portion has a value of 1/20 to 1/5 of the thickness of the substrate having the round portion R formed thereon.

According to the above-described manufacturing method of the organic light emitting diode display, by grinding the edges of the cut surface of the display substrate 310 using the grinder 10, flaws, such as cracks, generated on the edge portion caused by cutting can be eliminated or reduced, and the strength of the panel can be improved. Further, the smaller the thickness of the panel, the more susceptible the panel is to flaws, such as cracks, caused by cutting. Hence, a greater effect can be expected on medium and small-sized panels.

While the invention has been shown and described in conjunction with specific exemplary embodiments, the invention is not limited to these exemplary embodiments.

While this disclosure has been described in connection with what is presently considered to be some exemplary embodiments, it is to be understood that the invention is not limited to the disclosed embodiments, but, on the contrary, is intended to cover various modifications and equivalent arrangements included within the spirit and scope of the appended claims.

What is claimed is:

1. A manufacturing method of a liquid crystal display, the method comprising:

forming a thin film transistor on a first substrate;

forming a color filter on a second substrate;

forming a mother panel by bonding the first substrate and the second substrate together;

injecting liquid crystal between the first substrate and the second substrate;

cutting along a boundary of cells of the mother panel to separate a panel; and moving the panel to a grinder that is rotatable and comprises a grinding unit including a grinding surface and a shaft connected to the grinding unit and bringing at least one of edges of a cut surface of the panel to the grinding surface of the grinder to grind the at least one edge, wherein an angle $\alpha$ between a plane perpendicular to a rotational axis of the shaft and the grinding surface and an angle $\beta$ between the plane perpendicular to the rotational axis of the shaft and an outer surface of the panel perpendicular to the cut surface of the panel and facing the grinding surface of the grinder satisfy $1° \leq \alpha \leq 7°$ and $10° \leq \beta \leq 60°$, respectively.

2. The method of claim 1, wherein a diameter of the grinding unit of the grinder is smaller than a length of the at least one edge to be ground.

3. A manufacturing method of an organic light emitting diode display, the method comprising:

sequentially forming a thin film transistor and an organic light emitting diode on a first substrate;

forming a mother panel by bonding a second substrate onto the first substrate;

cutting along a boundary of cells of the mother panel to separate a panel; and moving the panel to a grinder that is rotatable and comprises a grinding unit including a grinding surface and a shaft connected to the grinding unit and bringing at least one of edges of a cut surface of the first substrate to the grinding surface of the grinder to grind the at least one edge, wherein an angle $\alpha$ between a plane perpendicular to a rotational axis of the shaft and the grinding surface and an angle $\beta$ between the plane perpendicular to the rotational axis of the shaft and an outer surface of the panel perpendicular to a cut surface of the panel and facing the grinding surface of the grinder satisfy $1° \leq \alpha \leq 7°$ and $10° \leq \beta \leq 60°$, respectively.

4. The method of claim 3, wherein a diameter of the grinding unit of the grinder is smaller than a length of the at least one edge of the first substrate to be ground.

5. The method of claim 3, wherein the second substrate comprises glass, and the first substrate and the second substrate are bonded together by a sealant applied onto the first substrate or the second substrate.

6. The method of claim 5, further comprising bringing at least one of edges of a cut surface of the second substrate into contact with the grinding surface of the grinder to grind the at least one edge of the cut surface of the second substrate.

7. The method of claim 6, wherein a diameter of the grinding unit of the grinder is smaller than a length of the at least one edge of the second substrate to be ground.

8. The method of claim 3, wherein the second substrate is formed of an encapsulation layer including a stack of a plurality of organic and inorganic films, and the first substrate and the second layer are bonded together by curing the encapsulation layer with ultraviolet light.

* * * * *